US010829879B2

(12) United States Patent
Shirotani et al.

(10) Patent No.: US 10,829,879 B2
(45) Date of Patent: Nov. 10, 2020

(54) CONDUCTIVE NONWOVEN FABRIC AND METHOD OF PRODUCING MELTBLOWN NONWOVEN FABRIC USED IN CONDUCTIVE NONWOVEN FABRIC

(71) Applicant: KURARAY CO., LTD., Kurashiki-shi (JP)

(72) Inventors: Yasuhiro Shirotani, Saijo (JP); Kimihiko Houhashi, Saijo (JP); Kazuo Ohira, Osaka (JP)

(73) Assignee: KURARAY CO., LTD., Kurashiki (JP)

( * ) Notice: Subject to any disclaimer, the term of this patent is extended or adjusted under 35 U.S.C. 154(b) by 29 days.

(21) Appl. No.: 15/505,495

(22) PCT Filed: Aug. 22, 2014

(86) PCT No.: PCT/JP2014/071979
§ 371 (c)(1),
(2) Date: Feb. 21, 2017

(87) PCT Pub. No.: WO2016/027361
PCT Pub. Date: Feb. 25, 2016

(65) Prior Publication Data

US 2017/0275793 A1 Sep. 28, 2017

(51) Int. Cl.
*D04H 3/16* (2006.01)
*D04H 3/011* (2012.01)
(Continued)

(52) U.S. Cl.
CPC ..... *D04H 3/16* (2013.01); *D01D 5/0985* (2013.01); *D01F 6/62* (2013.01); *D04H 1/435* (2013.01);
(Continued)

(58) Field of Classification Search
CPC ..... D01D 5/0985; D04H 3/011; D04H 3/016; D04H 3/16; D06M 11/83
See application file for complete search history.

(56) References Cited

U.S. PATENT DOCUMENTS 5,498,443 A 3/1996 Sobol
5,753,736 A 5/1998 Bhat et al.
(Continued)

FOREIGN PATENT DOCUMENTS

CN 1831228 A 9/2006
CN 101375652 A 2/2009
(Continued)

OTHER PUBLICATIONS https://patents.google.com/patent/JP2014201862A/en?q=nonwoven+fabric&q=%CE%BCm&q=mm&q=conductive&q=equal&q=thickness+&q=nonwoven+&q=meltspun&q=polyester&q=conductive&q=%22air+permeability%22&before=priority:20140822&scholar (Year: 2014).*
(Continued)

*Primary Examiner* — Arti Singh-Pandey
(74) *Attorney, Agent, or Firm* — Oblon, McClelland, Maier & Neustadt, L.L.P.

(57) ABSTRACT

Provided is a conductive nonwoven fabric, including a meltblown nonwoven fabric made from a melt liquid-crystal-forming wholly aromatic polyester having a melt viscosity at 310° C. of less than or equal to 20 Pa·s and satisfying (A) an average fiber diameter from 0.1 μm to 5 μm, (B) two or less film-like objects existing per 1 $mm^2$ of the nonwoven fabric, (C) a breaking length in a warp direction of greater than or equal to 10 km and a breaking length in a weft direction of greater than or equal to 6 km, (D) a basis weight from 1.0 $g/m^2$ to 15 $g/m^2$, (E) a thickness from 5 μm to 50 μm, and (F) an air permeability of less than or equal to 300
(Continued)

cc/cm$^2$/second, and a metal coating film formed on the meltblown nonwoven fabric.

20 Claims, 1 Drawing Sheet

(51) Int. Cl.

| | |
|---|---|
| ***D06M 11/83*** | (2006.01) |
| ***D01F 6/62*** | (2006.01) |
| ***D04H 1/435*** | (2012.01) |
| ***D01D 5/098*** | (2006.01) |
| ***D04H 3/016*** | (2012.01) |

(52) U.S. Cl.
CPC ..... *D04H 3/011* (2013.01); *D04H 3/016* (2013.01); *D06M 11/83* (2013.01)

(56) References Cited

U.S. PATENT DOCUMENTS

| | | | | |
|---|---|---|---|---|
| 2005/0079781 | A1* | 4/2005 | Tsujimoto ..... | D04H 3/12 442/59 |
| 2010/0203789 | A1 | 8/2010 | Takebayashi et al. | |
| 2010/0252426 | A1* | 10/2010 | Tsukuda ..... | H01G 9/02 204/296 |
| 2012/0003020 | A1 | 1/2012 | Furuya et al. | |
| 2012/0045626 | A1 | 2/2012 | Inokuma et al. | |
| 2012/0111627 | A1 | 5/2012 | Kato et al. | |
| 2012/0247868 | A1 | 10/2012 | Kato et al. | |
| 2013/0202851 | A1 | 8/2013 | Johnson | |

FOREIGN PATENT DOCUMENTS

| | | | | | |
|---|---|---|---|---|---|
| CN | 101501577 | A | | 8/2009 | |
| CN | 102105549 | A | | 6/2011 | |
| CN | 102414016 | A | | 4/2012 | |
| CN | 102474998 | A | | 5/2012 | |
| JP | 62-238698 | A | | 10/1987 | |
| JP | 63-262900 | A | | 10/1988 | |
| JP | 3-237799 | A | | 10/1991 | |
| JP | 7-138873 | A | | 5/1995 | |
| JP | 8-170295 | A | | 7/1996 | |
| JP | 2002-61064 | A | | 2/2002 | |
| JP | 2008-223189 | A | | 9/2008 | |
| JP | 2010-232121 | A | | 10/2010 | |
| JP | 2012-241292 | A | | 12/2012 | |
| JP | 2013-72142 | A | | 4/2013 | |
| JP | 2014201862 | A | * | 10/2014 | |
| JP | 6310364 | B2 | * | 4/2018 | ..... D04H 3/16 |
| TW | I363938 | B | | 5/2012 | |
| WO | WO 2007/083822 | A1 | | 7/2007 | |
| WO | WO 2010/011474 | A1 | | 1/2010 | |
| WO | WO 2011/010697 | A1 | | 1/2011 | |
| WO | WO 2011/074609 | A1 | | 6/2011 | |

OTHER PUBLICATIONS

Combined Taiwanese Office Action and Search Report dated Oct. 31, 2017 in Patent Application No. 103129709 (with English language translation).

International Search Report dated Nov. 25, 2014, in PCT/JP2014/071979 filed Aug. 22, 2014.

Combined Chinese Office Action and Search Report dated Sep. 27, 2018 in Chinese Patent Application No. 201480081414.X (with English translation), 24 pages.

"Theory, Technology and Application of Filtering of Soot Fibers", Edited by Xiang Xiaodong, Beijing, Metallurgical Industry Press, 2007, pp. 15-18 (w/ English translation).

Office Action dated Apr. 9, 2019, in Chinese Patent Application No. 201480081414.X (w/ English translation).

Decision for Grant of Patent issued Aug. 21, 2020, in Korean Patent Application No. 10-2017-7007469 filed Aug. 22, 2014 (with partial English translation).

* cited by examiner

CONDUCTIVE NONWOVEN FABRIC AND METHOD OF PRODUCING MELTBLOWN NONWOVEN FABRIC USED IN CONDUCTIVE NONWOVEN FABRIC

TECHNICAL FIELD

The present invention relates to a conductive nonwoven fabric that is very light and in a thin film form, shields against electromagnetic waves having a wide range of frequencies, has a wide range of applications such as electromagnetic-wave-shielding sheets, gaskets, and bags, and is particularly useful for applications inside electronic devices that are demanded to be smaller and thinner. The present invention also relates to a method of producing a meltblown nonwoven fabric used in the conductive nonwoven fabric.

BACKGROUND ART

In recent years, for preventing leakage of electromagnetic waves from electronic devices and leakage of information while transmitted via electromagnetic waves, electromagnetic-wave-shielding materials have been used. Among these, materials made of a woven or nonwoven fabric of synthetic polyester, nylon, acrylic, or similar fibers with a metal coating film formed thereon have both plasticity and/or flexibility attributed to the fiber material and an electromagnetic-wave-shielding ability attributed to the coating metal. These materials are widely used in such applications as electromagnetic-wave-shielding sheets, gaskets, tapes, and bags.

For example, Japanese Patent Laying-Open No. 62-238698 (PTD 1) discloses an electromagnetic-wave-shielding material primarily made of polyester or acrylic fibers. This electromagnetic-wave-shielding material is a nonwoven fabric having a cotton basis weight from 35 g/m$^2$ to 600 g/m$^2$, and the nonwoven fabric has a metal component adhered thereto by electroless plating. In addition, Japanese Patent Laying-Open No. 63-262900 (PTD 2) suggests an electromagnetic-wave-shielding material that is a flame-retardant nonwoven fabric made of a metal-plated fiber and a heat-fused fiber. The metal-plated fiber is a flame-retardant fiber made of an acrylonitrile/vinylidene chloride copolymer or the like that has a metal adhered thereto.

In these electromagnetic-wave-shielding materials of PTDs 1 and 2, however, the synthetic polyester, nylon, acrylic, or similar fiber as a base material has poor heat resistance. Therefore, these electromagnetic-wave-shielding materials are unsuitable for applications that require high heat resistance, such as in a flow step and a reflow step in mounting an electronic component on an electronic circuit substrate. For this reason, it has been difficult to premount these electromagnetic-wave-shielding materials on a circuit substrate prior to the electronic component mounting step. In addition, these electromagnetic-wave-shielding materials are not resistant against soldering heat. Therefore, it has been difficult to adopt a soldering technique when electrically connecting these electromagnetic-wave-shielding materials which are highly conductive per se to other metal materials.

The applicant proposes a nonwoven fabric having excellent heat resistance in Japanese Patent Laying-Open No. 8-170295 (PTD 3), for example. This nonwoven fabric is a heat-resistant sheet made of a certain proportion of a melt anisotropic polyester fibrous material having a logarithmic melt viscosity from 1 dl/g to 15 dl/g and a certain proportion of a melt anisotropic polyester fibrous material having a logarithmic melt viscosity of greater than or equal to 15 dl/g. This heat-resistant sheet has an average breaking length of greater than or equal to 3 km. In Japanese Patent Laying-Open No. 2002-61064 (PTD 4), the applicant also proposes a nonwoven fabric made of a melt liquid-crystal polyester fiber having an average fiber diameter from 0.6 μm to 20 μm. This nonwoven fabric has a breaking length in a warp direction of greater than or equal to 2.5 km, a breaking length in a weft direction of greater than or equal to 1.5 km, and a rate of area shrinkage at 300° C. over 1 hour of less than or equal to 3%. The terms "melt anisotropic" and "melt liquid-crystal" both refer to a characteristic of being optically anisotropic (liquid crystalline) in a molten phase.

In Japanese Patent Laying-Open No. 2008-223189 (PTD 5), the applicant also proposes a conductive nonwoven fabric, which is a nonwoven fabric made of a melt liquid-crystal-forming wholly aromatic polyester and serves as an electromagnetic-wave-shielding material described above. This conductive nonwoven fabric disclosed in PTD 5, however, has an average fiber diameter of substantially greater than or equal to 7 μm, and therefore has a poor nonwoven-fabric denseness in low basis-weight regions with basis weights of less than 15 g/m$^2$, thereby being inadequate in terms of strength and an electromagnetic-wave-shielding ability.

CITATION LIST

Patent Documents

PTD 1: Japanese Patent Laying-Open No. 62-238698
PTD 2: Japanese Patent Laying-Open No. 63-262900
PTD 3: Japanese Patent Laying-Open No. 8-170295
PTD 4: Japanese Patent Laying-Open No. 2002-61064
PTD 5: Japanese Patent Laying-Open No. 2008-223189

SUMMARY OF INVENTION

Technical Problems

An object of the present invention is to provide a conductive nonwoven fabric that is thin and highly tenacious and excellently shields against electromagnetic waves having a wide range of frequencies.

Solutions to Problems

The inventors of the present invention have conducted intensive research and, as a result, have found that the object described above can be achieved by conducting melt spinning with the use of a spinning nozzle having a certain structure, conducting heat treatment under certain heat treatment conditions, and forming a metal coating film on the resulting melt liquid-crystal-forming wholly aromatic polyester nonwoven fabric. Thus, the present invention has now been completed. More specifically, the present invention provides the following.

The conductive nonwoven fabric of the present invention includes:

a meltblown nonwoven fabric made from a melt liquid-crystal-forming wholly aromatic polyester having a melt viscosity at 310° C. of less than or equal to 20 Pa·s and satisfying (A), (B), (C), (D), (E), and (F); and a metal coating film formed on the meltblown nonwoven fabric:

(A) an average fiber diameter from 0.1 μm to 5 μm;

(B) two or less film-like objects existing per 1 $mm^2$ of the nonwoven fabric;

(C) a breaking length in the warp direction of greater than or equal to 10 km and a breaking length in the weft direction of greater than or equal to 6 km;

(D) a basis weight from 1.0 $g/m^2$ to 15 $g/m^2$;

(E) a thickness from 5 μm to 50 μm; and (F) an air permeability of less than or equal to 300 $cc/cm^2$/second.

The conductive nonwoven fabric of the present invention preferably further satisfies (G):

(G) a surface roughness (Ra) of less than or equal to 15 μm.

In the conductive nonwoven fabric of the present invention, the metal coating film is preferably made of any of copper, nickel, gold, silver, cobalt, tin, and zinc. In this case, the metal coating film may be made of an alloy or a laminate film of at least two of copper, nickel, gold, silver, cobalt, tin, and zinc.

The present invention also provides a conductive tape including the above-described conductive nonwoven fabric of the present invention.

The present invention also provides a method of producing a meltblown nonwoven fabric used in the above-described conductive nonwoven fabric of the present invention, the method including:

melt spinning the melt liquid-crystal-forming wholly aromatic polyester using a spinning nozzle to obtain a spun product while blowing the spun product at a spinning temperature from 310° C. to 360° C. with air in an amount from 5 $Nm^3$ to 30 $Nm^3$ per a width of the spinning nozzle of 1 m, thereby forming a web on a collecting plane; and conducting heat treatment to produce the meltblown nonwoven fabric, the melt spinning being conducted through the spinning nozzle having a nozzle spout size from 0.1 mm to 0.3 mm, a ratio (L/D) of a nozzle spout length (L) to the nozzle spout size (D) from 20 to 50, and a distance between nozzle spouts from 0.2 mm to 1.0 mm, the heat treatment being conducted at a temperature of greater than or equal to <(a melting point of the melt liquid-crystal-forming wholly aromatic polyester)−40° C.> and less than or equal to <(the melting point of the melt liquid-crystal-forming wholly aromatic polyester)+20° C.> for a period of greater than or equal to 3 hours.

The method of producing the conductive nonwoven fabric of the present invention preferably further includes:

continuously treating the meltblown nonwoven fabric between an elastic roll having a surface Shore D hardness from 85° to 95° and a metal roll at a temperature from 100° C. to 250° C. and a linear pressure from 100 kg/cm to 500 kg/cm.

Advantageous Effects of Invention

The present invention relates to a conductive nonwoven fabric that is very light and thin, shields against electromagnetic waves having a wide range of frequencies, has a wide range of applications such as electromagnetic-wave-shielding sheets, gaskets, and bags, and is particularly useful for applications inside electronic devices that are demanded to be smaller and thinner. The present invention also relates to a method of producing a meltblown nonwoven fabric used in the conductive nonwoven fabric.

DESCRIPTION OF EMBODIMENTS

Figure 1:
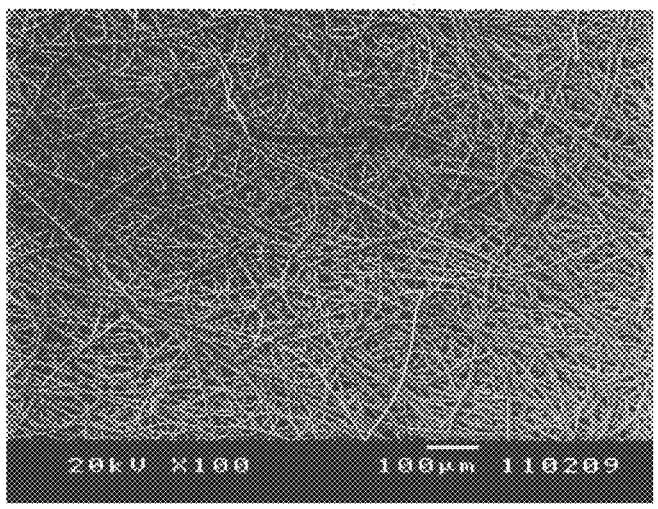
FIG. 1 is a scanning electron microscope photograph illustrating a surface of a nonwoven fabric of the present invention having no film-like object scattered thereon (0 film-like object per 1 $mm^2$).

In the following, the present invention will be described in detail.

<Conductive Nonwoven Fabric>

A conductive nonwoven fabric of the present invention includes a meltblown nonwoven fabric made from a melt liquid-crystal-forming wholly aromatic polyester and satisfying certain structural requirements, and a metal coating film formed on the meltblown nonwoven fabric. The conductive nonwoven fabric of the present invention is very light and thin, shields against electromagnetic waves having a wide range of frequencies, has a wide range of applications such as electromagnetic-wave-shielding sheets, gaskets, and bags, and is particularly useful for applications inside electronic devices that are demanded to be smaller and thinner.

(Meltblown Nonwoven Fabric)

The melt liquid-crystal-forming wholly aromatic polyester used in the meltblown nonwoven fabric of the present invention is a resin having excellent heat resistance and excellent chemical resistance. The melt liquid-crystal-forming wholly aromatic polyester of the present invention is an aromatic polyester that is optically anisotropic (liquid crystalline) in a molten phase. The term "melt liquid-crystal-forming" refers to the same characteristic as "melt liquid-crystal" and "melt anisotropic" described above do. To check whether a specimen is "melt liquid-crystal-forming," the specimen may be placed on a hot stage and heated in a nitrogen atmosphere for examination of light transmitted through the specimen, for example.

A main component of the melt liquid-crystal-forming wholly aromatic polyester is a repeating structural unit of an aromatic diol, an aromatic dicarboxylic acid, and an aromatic hydroxycarboxylic acid. The term "main component" refers to a component accounting for greater than or equal to 60%, more preferably greater than or equal to 80%, particularly preferably 100% of the repeating structural units constituting the melt liquid-crystal-forming wholly aromatic polyester. The term "wholly aromatic" herein refers to a characteristic of a polyester in which all of the repeating structural units as its main components contain an aromatic ring (a repeating structural unit other than the main components may contain no aromatic ring, as in the case of a repeating structural unit group (2)). Preferable examples of repeating structural units of the melt liquid-crystal-forming wholly aromatic polyester of the present invention include the following repeating structural unit group combinations.

[Chem. 1]

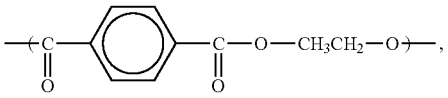

(1)

-continued

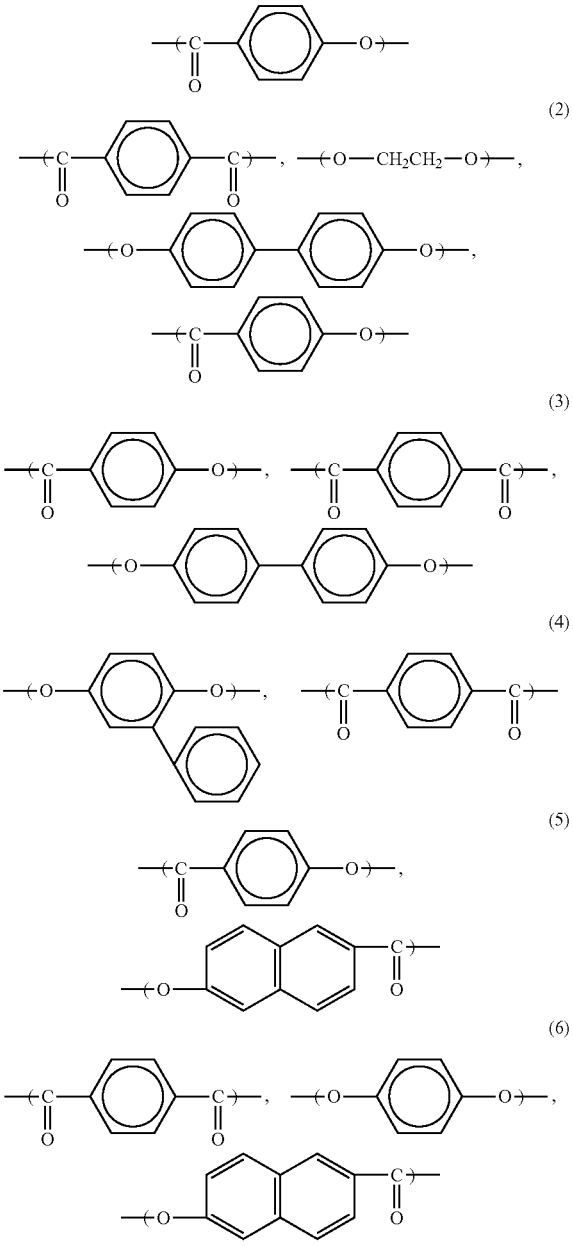

Among these repeating structural unit group combinations, a combination of p-hydroxybenzoic acid and 2-hydroxy-6-naphthoic acid (the combination (5) above) or a combination of p-hydroxybenzoic acid, 2-hydroxy-6-naphthoic acid, terephthalic acid, and biphenol (the combination (2) above) is preferable as the melt liquid-crystal-forming wholly aromatic polyester used in the present invention.

An important characteristic of the melt liquid-crystal-forming wholly aromatic polyester used in the present invention is to have a melt viscosity at 310° C. of less than or equal to 20 Pa·s. A melt viscosity at 310° C. of greater than 20 Pa·s is unpreferable for such reasons that ultrafine fibers are difficult to obtain, oligomers are generated during polymerization, and troubles occur during polymerization and during granulation. When the melt viscosity is too low, on the other hand, fibers are difficult to obtain. Therefore, the melt viscosity at 310° C. is desirably greater than or equal to 5 Pa·s. The melt viscosity of the melt liquid-crystal-forming wholly aromatic polyester at 310° C. refers to a value measured with a melt indexer (L244 manufactured by Takarakogyo), for example.

To the melt liquid-crystal-forming wholly aromatic polyester, a typical additive such as a colorant, an inorganic filler, an antioxidant, and an ultraviolet absorber as well as a thermoplastic elastomer may be added as needed as long as the functions of the present invention are not impaired.

The conductive nonwoven fabric of the present invention includes the meltblown nonwoven fabric containing the melt liquid-crystal-forming wholly aromatic polyester as described above as a main component and satisfying certain components (A), (B), (C), (D), (E), and (F) (desirably, further satisfying component (G)).

A fiber of the meltblown nonwoven fabric of the present invention has an average fiber diameter within a range from 0.1 μm to 5 μm (component (A)). When the average fiber diameter is less than 0.1 μm, cotton fly is readily produced to form fibrous lumps. When the average fiber diameter is greater than 5 μm, the texture is rough, resulting in an inadequate electromagnetic-wave-shielding effect of the metal coating film. Therefore, the average fiber diameter of a fiber of the meltblown nonwoven fabric of the present invention is preferably within a range from 0.5 μm to 4 μm, further preferably within a range from 1 μm to 3 μm. The average fiber diameter of a fiber of the meltblown nonwoven fabric of the present invention refers to the average value of diameters of any 100 fibers of the nonwoven fabric measured in a photograph taken with a scanning electron microscope under magnification.

Figure 2:
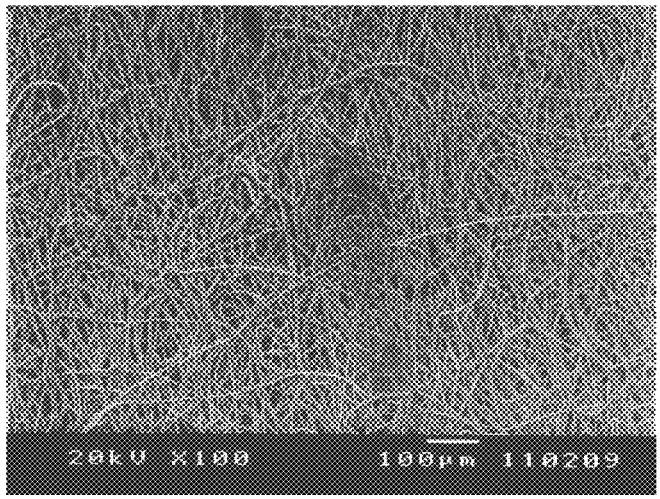
FIG. 2 is a scanning electron microscope photograph illustrating a surface of a conventional nonwoven fabric having film-like objects scattered thereon.

In the meltblown nonwoven fabric of the present invention, two or less film-like objects exist per 1 $mm^2$ of the meltblown nonwoven fabric (component (B)). When the number of film-like objects existing per 1 $mm^2$ is greater than two, these film-like objects result in defects and then in inadequate tenacity after heat treatment which is a later step. FIG. 1 is a photograph taken with a scanning electron microscope (JSM-5300LV manufactured by JEOL Ltd.) under a magnification of 100 times, illustrating a surface of a nonwoven fabric of the present invention (Example 4 below) having no film-like object scattered thereon (0 film-like object per 1 $mm^2$). FIG. 2 is a photograph of film-like objects taken with a scanning electron microscope (JSM-5300LV manufactured by JEOL Ltd.) under a magnification of 100 times. The film-like object refers to a fibrous bundle and lump having a size from 0.02 $mm^2$ to 2 $mm^2$ as shown in FIG. 2, observed in a photograph taken with a scanning electron microscope under magnification.

The meltblown nonwoven fabric of the present invention has a breaking length in a warp direction of greater than or equal to 10 km and a breaking length in a weft direction of greater than or equal to 6 km (component (C)), and such high tenacity can never be achieved by a conventional nonwoven fabric of a melt liquid-crystal-forming wholly aromatic polyester. For this reason, the meltblown nonwoven fabric of the present invention can have a low basis weight (a basis weight of less than or equal to 15 $g/m^2$, as described below). The warp direction refers to a direction parallel to a machine direction (MD), and the weft direction refers to a transverse direction (TD) vertical to the machine direction. When the breaking length of the nonwoven fabric is too small, breakage occurs due to tension generated during a metal coating film process, which is unfavorable. When the breaking length is too large, workability in cutting and die-cutting is poor, which is also unfavorable. Therefore, the breaking length in the warp direction of the meltblown nonwoven fabric of the present invention is preferably within a range from 10 km to 100 km, more preferably within a range from 20 km to 50 km, and the breaking length in the weft direction of the meltblown nonwoven fabric of the present invention is preferably within a range from 6 km to 50 km, more preferably within a range from 10 km to 30 km.

The meltblown nonwoven fabric of the present invention has a basis weight within a range from 1.0 g/m$^2$ to 15 g/m$^2$ (component (D)). When the basis weight of the meltblown nonwoven fabric is less than 1.0 g/m$^2$, the texture of the nonwoven fabric is rough, resulting in inadequate tenacity and an inadequate electromagnetic-wave-shielding effect of the metal coating film. A basis weight of the meltblown nonwoven fabric of greater than 15 g/m$^2$, on the other hand, is unpreferable from the viewpoint of weight reduction of the conductive nonwoven fabric including the meltblown nonwoven fabric. Therefore, the basis weight of the meltblown nonwoven fabric is preferably within a range from 2 g/m$^2$ to 12 g/m$^2$, more preferably within a range from 3 g/m$^2$ to 10 g/m$^2$.

The meltblown nonwoven fabric of the present invention has a thickness within a range from 5 μm to 50 μm (component (E)). When the thickness of the meltblown nonwoven fabric is less than 5 μm, a pressure-sensitive adhesive used for forming the meltblown nonwoven fabric into tape readily bleeds through. When the thickness of the meltblown nonwoven fabric is greater than 50 μm, such a thickness is unfavorable for thinning the meltblown nonwoven fabric. Therefore, the thickness of the meltblown nonwoven fabric is preferably within a range from 7 μm to 40 μm, more preferably within a range from 9 μm to 35 μm.

The meltblown nonwoven fabric of the present invention has an air permeability of less than or equal to 300 cc/cm$^2$/second (component (F)). When the air permeability of the meltblown nonwoven fabric is greater than 300 cc/cm$^2$/second, the texture is rough, resulting in an inadequate electromagnetic-wave-shielding effect of the metal coating film. For uniform texture, the air permeability of the meltblown nonwoven fabric is less than or equal to 280 cc/cm$^2$/second, further preferably less than or equal to 250 cc/cm$^2$/second. A lower limit of the air permeability of the meltblown nonwoven fabric of the present invention is not particularly limited. From the viewpoint of air elimination while the conductive nonwoven fabric is impregnated with a molten, reinforcing thermoplastic resin and then laminated on top of another or while the conductive nonwoven fabric is impregnated with a reinforcing thermosetting resin and then laminated on top of another, the lower limit of the air permeability of the meltblown nonwoven fabric of the present invention is preferably greater than or equal to 1 cc/cm$^2$/second.

The meltblown nonwoven fabric of the present invention, which satisfies all the components (A), (B), (C), (D), (E), and (F) described above, preferably has a surface roughness (arithmetic mean roughness) (Ra) of less than or equal to 15 μm (component (G)). When the surface roughness (Ra) of the meltblown nonwoven fabric is less than or equal to 15 μm and thereby has a smooth surface, the conductive nonwoven fabric including the meltblown nonwoven fabric can have an excellent electromagnetic-wave-shielding ability even when the basis weight is small (less than or equal to 15 g/m$^2$, for example). For excellent shielding, the surface roughness (Ra) of the meltblown nonwoven fabric is preferably less than or equal to 10 μm, preferably less than or equal to 5 μm. In the case where a pressure-sensitive adhesive or an adhesive is applied to the conductive nonwoven fabric to obtain a conductive tape, the surface roughness (Ra) of the meltblown nonwoven fabric is preferably greater than or equal to 0 μm, more preferably greater than or equal to 1 μm, for adhesion with the pressure-sensitive adhesive or the adhesive. The meltblown nonwoven fabric having this preferable surface roughness can be suitably produced by conducting, in production of the meltblown nonwoven fabric to be described below, continuous treatment of the meltblown nonwoven fabric being passed between an elastic roll having a surface Shore D hardness from 85° to 95° and a metal roll at a temperature from 150° C. to 300° C. and a linear pressure from 100 kg/cm to 500 kg/cm. However, the method of obtaining the meltblown nonwoven fabric having this preferable surface roughness (Ra) is not limited thereto.

(Metal Coating Film)

It is preferable that the metal coating film used in the conductive nonwoven fabric of the present invention is made of any of copper, nickel, gold, silver, cobalt, tin, and zinc or made of an alloy or a laminate film of at least two of copper, nickel, gold, silver, cobalt, tin, and zinc. Among these, a copper coating film, a nickel coating film, a gold coating film, or a laminate film made of at least two of copper, nickel, and gold is particularly preferable in terms of high conductivity, easy formation of the metal coating film, and the like. It is most preferable that the metal coating film is made of copper, among these, because copper is highly conductive and capable of easily imparting an electromagnetic-wave-shielding ability. It is particularly preferable that the copper coating film has nickel laminated thereon for inhibiting surface oxidation.

The thickness of the metal coating film in the conductive nonwoven fabric of the present invention is preferably within a range from 0.05 μm to 10 μm, more preferably within a range from 0.1 μm to 5 μm. A thickness of the metal coating film of less than 0.05 μm is unpreferable because adequate conductivity is not obtained. A thickness of the metal coating film greater than 10 μm is also unpreferable because plasticity and flexibility of the nonwoven fabric are impaired.

The conductive nonwoven fabric of the present invention is conductive because of the metal coating film described above formed on a surface of a fiber of the meltblown nonwoven fabric described above. The surface resistance of the conductive nonwoven fabric of the present invention may vary depending on the type and the thickness of the metal coating film. From the viewpoint of an adequate electromagnetic-wave-shielding ability, the surface resistance is preferably within a range from $10^{-3}\Omega/\square$ to $1\Omega/\square$, more preferably within a range from $10^{-3}\Omega/\square$ to $10^{-1}\Omega/\square$.

<Conductive Tape>

The present invention also provides a conductive tape including the above-described conductive nonwoven fabric of the present invention. In the conductive tape of the present invention, one side of the meltblown nonwoven fabric opposite to the side thereof having the metal coating film formed thereon, for example, may have an adhesive or a pressure-sensitive adhesive applied thereto, and may further have a release film as needed laminated thereon that is detachable on use of the tape for exposing the adhesive or the pressure-sensitive adhesive. The adhesive, the pressure-sensitive adhesive, the release film, and the like used in the conductive tape of the present invention are not particularly limited, and may be an appropriate adhesive, an appropriate pressure-sensitive adhesive, and an appropriate release film that are conventionally known.

<Method of Producing Meltblown Nonwoven Fabric>

The present invention also provides a preferable method of producing the meltblown nonwoven fabric in the above-described conductive nonwoven fabric of the present invention. The method of producing the meltblown nonwoven fabric of the present invention includes melt spinning the melt liquid-crystal-forming wholly aromatic polyester using a spinning nozzle to obtain a spun product while blowing the spun product at a spinning temperature from 310° C. to 360° C. with air in an amount from 5 $Nm^3$ to 30 $Nm^3$ per a width of the spinning nozzle of 1 m, thereby forming a web on a collecting plane, and conducting heat treatment to produce the meltblown nonwoven fabric, the melt spinning being conducted through the spinning nozzle having a nozzle spout size from 0.1 mm to 0.3 mm, a ratio (L/D) of a nozzle spout length (L) to the nozzle spout size (D) from 20 to 50, and a distance between nozzle spouts from 0.2 mm to 1.0 mm, the heat treatment being conducted at a temperature of greater than or equal to <(a melting point of the melt liquid-crystal-forming wholly aromatic polyester)−40° C.> and less than or equal to <(the melting point of the melt liquid-crystal-forming wholly aromatic polyester)+20° C.> for a period of greater than or equal to 3 hours.

In the method of producing the meltblown nonwoven fabric of the present invention, a spinning apparatus used may be a conventionally known meltblowing apparatus, and the spinning nozzle used has a nozzle spout size (diameter) from 0.1 mm to 0.3 mm. When the nozzle spout size is less than 0.1 mm, the nozzle is readily clogged. When the nozzle spout size is greater than 0.3 mm, the discharge pressure to be obtained tends to be inadequate, resulting in the molten resin moving within a nozzle spout, leading to fiber breakage. For constant discharge pressure and stable fine-fiber production, the nozzle spout size of the spinning nozzle is preferably from 0.15 mm to 0.2 mm.

The spinning nozzle used in the method of producing the meltblown nonwoven fabric of the present invention has a ratio (L/D) of the nozzle spout length (L) to the nozzle spout size (D) from 20 to 50. When the ratio L/D is less than 20, a polymer orientation is inadequate and consequently fiber breakage readily occurs. When the ratio L/D is greater than 50, pressure loss within the nozzle tube is large, resulting in a great load applied to the nozzle, leading to a decrease in nozzle durability. The nozzle durability can be maintained by decreasing polymer discharge, which, however, leads to a decrease in productivity. For constant discharge pressure and stable fine-fiber production, the ratio L/D is preferably from 25 to 45.

In the method of producing the meltblown nonwoven fabric of the present invention, the distance between nozzle spouts is from 0.2 mm to 1.0 mm. When the distance between nozzle spouts is less than 0.2 mm, adjacent fibers readily fuse each other immediately after spinning and thereby form fibrous lumps, resulting in impaired uniformity. When the distance between nozzle spouts is greater than 1.0 mm, the over-sized space between fibers impairs uniformity as well. For stably obtaining a uniform nonwoven fabric, the distance between nozzle spouts is preferably from 0.25 mm to 0.75 mm.

In the method of producing the meltblown nonwoven fabric of the present invention, spinning conditions include a spinning temperature from 310° C. to 360° C. and an air amount (per 1 m of nozzle length) from 5 $Nm^3$ to 30 $Nm^3$. When the spinning temperature is less than 310° C., the melt viscosity is high and consequently the pressure loss within a nozzle tube is high, whereby durability of the nozzle decreases and production of fine fibers is difficult, which are unfavorable. When the spinning temperature is greater than 360° C., degradation of the molten resin is facilitated to cause fiber breakage, which is unfavorable. When the air amount per the width of the nozzle of 1 m is less than 5 $Nm^3$, production of fine fibers is difficult, which is unfavorable. When the air amount per the width of the nozzle of 1 m is greater than 30 $Nm^3$, fiber breakage occurs, which is also unfavorable. For inhibiting molten resin degradation and fiber breakage and stably obtaining fine fibers, it is preferable that the spinning temperature is from 315° C. to 355° C. and the air amount per the width of the nozzle of 1 m is from 10 $Nm^3$ to 25 $Nm^3$, and it is more preferable that the spinning temperature is from 330° C. to 350° C. and the air amount per the width of the nozzle of 1 m is from 15 $Nm^3$ to 20 $Nm^3$. For inhibiting fiber breakage and obtaining fine fibers, a hot-air temperature (initial air temperature) among the spinning conditions is preferably from 310° C. to 380° C., more preferably from 330° C. to 360° C.

In the method of producing the meltblown nonwoven fabric of the present invention, the nonwoven fabric produced through the spinning nozzle by melt spinning as described above is subjected to heat treatment at a temperature of greater than or equal to <(the melting point of the melt liquid-crystal-forming wholly aromatic polyester)−40° C.> and less than or equal to <(the melting point of the melt liquid-crystal-forming wholly aromatic polyester)+20° C.> for a period of greater than or equal to 3 hours. Examples of a gas used as a heating medium in the heat treatment include a mix gas such as nitrogen, oxygen, argon, or carbon dioxide gas or air. In terms of cost, oxygen or air is more preferable. The heat treatment may be conducted either under stretching conditions or non-stretching conditions depending on the purpose.

When the heat treatment is conducted at a temperature of less than <(the melting point of the melt liquid-crystal-forming wholly aromatic polyester)−40° C.>, heat resistance to be obtained is inadequate, which is unfavorable. When the heat treatment is conducted at a temperature of greater than <(the melting point of the melt liquid-crystal-forming wholly aromatic polyester)+20° C.>, the polymer softens and the resulting fibers start to melt to cause partial conversion from a sheet form to a film form, resulting in a loss of breathability of the nonwoven fabric as well as in space blockage, for instance, which are also unfavorable.

By the above-described method of producing the meltblown nonwoven fabric of the present invention, the meltblown nonwoven fabric of the present invention satisfying components (A), (B), (C), (D), (E), and (F) described above (desirably, further satisfying component (G)) can be suitably produced.

In the method of producing the meltblown nonwoven fabric of the present invention, it is preferable to conduct continuous treatment of the meltblown nonwoven fabric being passed between an elastic roll having a surface Shore D hardness from 85° to 950 (preferably from 87° to 950, particularly preferably from 910 to 940) and a metal roll at a temperature from 100° C. to 250° C. and a linear pressure from 100 kg/cm to 500 kg/cm. When such a combination of an elastic roll having an appropriate hardness (high hardness) and a metal roll is used, a nonwoven fabric having an adequately small thickness can be produced. In addition, this combination of rolls can excellently follow the contour of the nonwoven fabric to enable uniform processing. Therefore, this combination of rolls can suitably produce the meltblown nonwoven fabric having the desired surface roughness (Ra) described above (component (G)).

When an elastic roll having a surface Shore D hardness of greater than 95° is used in combination with a metal roll or when two metal rolls are used in combination, the nonwoven fabric can be adequately compressed for thickness reduction, but one or both rolls have too high a surface hardness to excellently follow the contour of the nonwoven fabric. In this way, nonuniform profiles (irregularities and texture) of the nonwoven fabric may remain in the resulting product.

When an elastic roll having a surface Shore D hardness of less than 85° is used in combination with a metal roll, compression of the nonwoven fabric does not proceed adequately and therefore denseness of the nonwoven fabric is not enhanced. When the surface Shore D hardness of the elastic roll is greater than 95° or the surface hardness of the elastic roll is too low, nonuniform profiles of the nonwoven fabric described above may remain.

The material for the elastic roll suitably used in the method of producing the meltblown nonwoven fabric of the present invention is not particularly limited as long as the elastic roll has a surface Shore D hardness within the range described above. An appropriate conventionally known elastic roll made of rubber, resin, paper, cotton, aramid fiber, or the like may be used. The elastic roll may be a commercially available product. More specifically, an elastic resin roll manufactured by Yuri Roll Co., Ltd. may be suitably used, for example.

The metal roll suitably used in the method of producing the meltblown nonwoven fabric of the present invention is made of metal, and the type of the metal is not particularly limited. An appropriate conventionally known metal roll may be used. For example, a SUS metal roll may be suitably used.

In the method of producing the meltblown nonwoven fabric of the present invention, the continuous treatment by means of a combination of the elastic roll and the metal roll described above is conducted at a temperature within a range from 100° C. to 250° C. When the temperature is less than 100° C., heat for melting fibers for adhesion tends to be insufficient, resulting in failed compression and failed densification. When the temperature is greater than 250° C., adhesion of the molten nonwoven fabric to the rolls tends to be too strong for the nonwoven fabric to detach from the rolls (resulting in breakage of the nonwoven fabric). For achieving all of compression, densification, and stable production, the continuous treatment by means of a combination of the elastic roll and the metal roll is preferably conducted at a temperature within a range from 120° C. to 230° C., particularly preferably at a temperature within a range from 150° C. to 200° C.

In the method of producing the meltblown nonwoven fabric of the present invention, the continuous treatment by means of a combination of the elastic roll and the metal roll described above is conducted at a linear pressure from 100 kg/cm to 500 kg/cm. When the linear pressure is less than 100 kg/cm, heat for melting fibers for adhesion tends to be insufficient, resulting in failed compression and failed densification. When the linear pressure is greater than 500 kg/cm, the nonwoven fabric tends to break. From the viewpoint of compression, densification, and stable production, the continuous treatment by means of a combination of the elastic roll and the metal roll is preferably conducted at a linear pressure within a range from 130 kg/cm to 400 kg/cm, particularly preferably at a linear pressure within a range from 160 kg/cm to 330 kg/cm.

<Method of Producing Conductive Nonwoven Fabric>

The conductive nonwoven fabric of the present invention can be produced by forming the metal coating film on the meltblown nonwoven fabric produced as described above. The method of forming the metal coating film may be a conventionally known method, such as electroplating, electroless plating, sputtering, or vacuum deposition. From the viewpoint of easily obtaining high conductivity, a method using electroless plating is preferable. The method of electroless plating is not particularly limited, and may be a conventionally known method. A method typically adopted for forming the metal coating film is a method involving applying a catalyst to a surface of a fiber of the nonwoven fabric serving as a base material and then immersing the resultant in a chemical plating bath in which a metal salt, a reducing agent, and a buffer are dissolved.

The present invention will be described below in more detail by way of examples. The scope of the present invention, however, is not limited to these examples. Physical properties of the nonwoven fabric of the present invention were measured by the following methods.

[Average Fiber Diameter (μm)]

A scanning electron microscope was used to take a photograph of any point in a nonwoven fabric under a magnification of 1000 times. The average value of diameters of 100 fibers was defined as the average fiber diameter of the meltblown nonwoven fabric.

[Breaking Length (Km)]

In accordance with JIS L 1906A, AUTOGRAPH manufactured by Shimadzu Corporation was used for measuring tenacities at break at points of a meltblown nonwoven fabric (three points each in the warp direction and in the weft direction). The average value in the respective direction was substituted into the following expression to calculate the breaking length of the meltblown nonwoven fabric.

Breaking length=<(tenacity(*N*))/(transverse length measured (mm))/(basis weight (g/m$^2$))/9.8>×1000

[Area of Film-Like Objects, Number of Film-Like Objects]

Each of any ten 1-mm$^2$ areas in a nonwoven fabric was photographed with a scanning electron microscope under a magnification of 100 times. A fibrous bundle or lump was defined as a film-like object. The area of film-like objects and the number of the film-like objects were determined, and the average value of the area and the number was determined (numbers of decimal places were rounded off).

[Basis Weight (g/m$^2$)]

Measurement was conducted in accordance with JIS L 1906. Three specimens each 20-cm long and 20-cm wide were obtained from a 1-m transverse span of an adhesive sheet, and each specimen was weighted on an electronic balance. The average value of the resulting three mass values was divided by the area of the specimen (400 cm$^2$) to obtain the mass per unit area, which was defined as the basis weight of the meltblown nonwoven fabric.

[Thickness (Mm)]

Measurement was conducted in accordance with JIS L 1906. The same specimens as used in the basis weight measurement were used. For each specimen, thicknesses at five points were measured with a digital thickness gauge (model BI manufactured by Toyoseiki Kogyo Co., Ltd.) having a diameter of 16 mm and a load of 20 gf/cm$^2$. The average value of the resulting 15 values was defined as the thickness of the meltblown nonwoven fabric.

[Air Permeability (Cc/Cm$^2$/Second)]

Measurement was conducted in accordance with JIS L 1096 6.27.1 (the method A, the Frajour method). The same specimens as used in the basis weight measurement were used. Each specimen was subjected to measurement with an air permeability tester (FX3300 manufactured by TEXTEST (Switzerland)) under conditions of a measurement area of 38 $cm^2$ and a measurement pressure of 125 Pa. The average value of the resulting 3 values was defined as the air permeability of the meltblown nonwoven fabric.

[Average Roughness (Arithmetic Mean Roughness) (Ra) (μm)]

In accordance with JIS B0601-1994, the average roughness (arithmetic mean roughness) (Ra) of a meltblown nonwoven fabric was measured with a roughness degree tester, which was a laser-type microscope (VK-8500 manufactured by Keyence Corporation).

[Melting Point (° C.) of Conductive Nonwoven Fabric]

Heat resistance of a conductive nonwoven fabric was measured with a differential scanning calorimeter (DSC-60 manufactured by Shimadzu Corporation) at a heating rate of 10° C./min.

[Electromagnetic-Wave-Shielding Ability (dB) of Conductive Nonwoven Fabric]

A measurement cell (MWF-06-P031-1 manufactured by Microwave Factory Co., Ltd.) devised by KEC Electronic Industry Development Center was used. An electromagnetic wave from 100 MHz to 1 GHz was generated with a vector-type network analyzer (PNA-E8363B manufactured by Agilent Technologies), transmitted from the measurement cell, and received through a conductive nonwoven fabric. The transmittance in this operation was measured and defined as the electromagnetic-wave-shielding ability. More specifically, the transmittance at each frequency of 100 MHz or 1 GHz was defined as the electromagnetic-wave-shielding ability.

[Surface Resistance (Ω/□) of Conductive Nonwoven Fabric]

Surface resistance of a conductive nonwoven fabric was measured in accordance with JIS-K-7194 by the four-terminal four-probe method with a resistance tester (MULTIMETER 3478A manufactured by Hewlett-Packard).

Example 1

(1) A melt liquid-crystal-forming wholly aromatic polyester formed of a (p-hydroxybenzoic acid)-(6-hydroxy-2-naphthoic acid) copolymer and having a melting point of 300° C. and a melt viscosity at 310° C. of 15 Pa·s was extruded from a twin screw extruder. The resultant was fed into a meltblown-nonwoven-fabric production unit equipped with a nozzle having a nozzle spout size (diameter) of 0.15 mm, an L/D ratio of 30, and a number of spouts per 1-m width of 1500 (distance between nozzle spouts, 0.67 mm) and then sprayed at a discharge amount per spout of 0.10 g/minute, a resin temperature of 330° C., a hot-air temperature of 330° C., and an air amount of 18 $Nm^3$ per the width of the nozzle of 1 m to obtain a nonwoven fabric having a basis weight of 15 $g/m^2$, which was subjected to heat treatment in air at 300° C. for 6 hours. Subsequently, the resulting nonwoven fabric was subjected to continuous treatment, in which the nonwoven fabric was passed between a rubber roll having a Shore D hardness of 60 (manufactured by Yuri Roll Co., Ltd.) and a SUS metal roll (manufactured by Yuri Roll Co., Ltd.) at a temperature of 120° C. and a linear pressure of 30 kg/cm. The resulting meltblown nonwoven fabric had an average fiber diameter of 2.7 μm (satisfied component (A)), a number of film-like objects existing per 1 $mm^2$ of the nonwoven fabric of 0 (satisfied component (B)), a tensile tenacity in the warp direction of 70 N/15 mm, a tensile tenacity in the weft direction of 24 N/15 mm, a breaking length in the warp direction of 32 km, and a breaking length in the weft direction of 11 km (satisfied component (C)), a basis weight of 15 $g/m^2$ as described above (satisfied component (D)), a thickness of 34 μm (satisfied component (E)), and an air permeability of 20 $cc/cm^2$/second (satisfied component (F)). Thus, the resulting meltblown nonwoven fabric was low in basis weight, small in thickness, high in denseness, and very high in tenacity.

(2) To a surface of a fiber of the meltblown nonwoven fabric obtained in (1), a palladium catalyst was applied. The resultant was immersed in an electroless copper plating solution containing copper sulfate and potassium sodium tartrate (Rochelle salt), followed by rinsing with water to form a copper coating film on the surface of the nonwoven fabric. Subsequently, the resultant was immersed in a nickel electroplating solution for forming a nickel coating film by electrolytic plating, followed by rinsing with water and drying. In this way, a conductive nonwoven fabric having the copper coating film and the nickel coating film laminated on top of the copper coating film was obtained. The resulting conductive nonwoven fabric had a melting point of 335° C. and thereby had very high heat resistance. The conductive nonwoven fabric had an excellent electromagnetic-wave-shielding ability of 81 (dB) at a frequency of 100 MHz and 80 (dB) at a frequency of 1 GHz. The conductive nonwoven fabric had a surface resistance of 0.030 (Ω/□).

Example 2

A meltblown nonwoven fabric having a basis weight of 6 $g/m^2$ (satisfied component (D)) was produced in the same manner as in Example 1. The nonwoven fabric had an average fiber diameter of 2.6 μm (satisfied component (A)), a number of film-like objects existing per 1 $mm^2$ of the nonwoven fabric of 0 (satisfied component (B)), a breaking length in the warp direction of 27 km, and a breaking length in the weft direction of 9 km (satisfied component (C)), a tensile tenacity in the warp direction of 24 N/15 mm, a tensile tenacity in the weft direction of 8 N/15 mm, a thickness of 17 μm (satisfied component (E)), and an air permeability of 80 $cc/cm^2$/second (satisfied component (F)). Thus, the resulting meltblown nonwoven fabric was low in basis weight, small in thickness, high in denseness, and very high in tenacity. Then, a copper/nickel metal laminate film was formed on a surface of a fiber of the meltblown nonwoven fabric in the same manner as in Example 1. In this way, a conductive nonwoven fabric was obtained. The resulting conductive nonwoven fabric had a melting point of 340° C. and thereby had very high heat resistance. The conductive nonwoven fabric had an excellent electromagnetic-wave-shielding ability of 75 (dB) at a frequency of 100 MHz and 72 (dB) at a frequency of 1 GHz. The conductive nonwoven fabric had a surface resistance of 0.090 (Ω/□).

Example 3

A nonwoven fabric having a basis weight of 3 $g/m^2$ (satisfied component (D)) was produced in the same manner as in Example 1. The nonwoven fabric had an average fiber diameter of 2.6 μm (satisfied component (A)), a number of film-like objects existing per 1 $mm^2$ of the nonwoven fabric of 0 (satisfied component (B)), a tensile tenacity in the warp direction of 12 N/15 mm, a tensile tenacity in the weft direction of 3 N/15 mm, a breaking length in the warp direction of 27 km, and a breaking length in the weft direction of 7 km (satisfied component (C)), a thickness of 9 μm (satisfied component (E)), and an air permeability of 240 cc/cm$^2$/second (satisfied component (F)). Thus, the resulting nonwoven fabric was low in basis weight, small in thickness, and high in tenacity. Then, a copper/nickel metal laminate film was formed on a surface of a fiber in the same manner as in Example 1. In this way, a conductive nonwoven fabric was obtained. The resulting conductive nonwoven fabric had a melting point of 345° C. and thereby had very high heat resistance. The conductive nonwoven fabric had an excellent electromagnetic-wave-shielding ability of 70 (dB) at a frequency of 100 MHz and 68 (dB) at a frequency of 1 GHz. The conductive nonwoven fabric had a surface resistance of 0.10 (f/O).

Comparative Example 1

The same melt liquid-crystal-forming wholly aromatic polyester as that in Example 1 was extruded from a twin screw extruder and then fed into a meltblown-nonwoven-fabric production unit equipped with a nozzle having a nozzle spout size (diameter) of 0.08 mm, an L/D ratio of 30, and a number of spouts per 1-m width of 1300 (distance between nozzle spouts, 0.77 mm). Because of the small nozzle spout size, the nozzle was clogged frequently and a desired nonwoven fabric was not obtained.

Comparative Example 2

The same melt liquid-crystal-forming wholly aromatic polyester as that in Example 1 was extruded from a twin screw extruder and then fed into a meltblown-nonwoven-fabric production unit equipped with a nozzle having a nozzle spout size (diameter) of 0.4 mm, an L/D ratio of 30, and a number of spouts per 1-m width of 1300 (distance between nozzle spouts, 0.77 mm). Spraying was conducted at a discharge amount per spout of 0.10 g/minute, a resin temperature of 330° C., a hot-air temperature of 330° C., and an air amount of 18 Nm$^3$ per the width of the nozzle of 1 m. Because the nozzle spout size was too large, frequent fiber breakage occurred immediately below the nozzle and many cotton flies scattered. In this way, a desired nonwoven fabric was not obtained.

Comparative Example 3

The same melt liquid-crystal-forming wholly aromatic polyester as that in Example 1 was extruded from a twin screw extruder and then fed into a meltblown-nonwoven-fabric production unit equipped with a nozzle having a nozzle spout size (diameter) of 0.15 mm, an L/D ratio of 15, and a number of spouts per 1-m width of 1300 (distance between nozzle spouts, 0.77 mm). Spraying was conducted at a discharge amount per spout of 0.10 g/minute, a resin temperature of 330° C., a hot-air temperature of 330° C., and an air amount of 18 Nm$^3$ per the width of the nozzle of 1 m. Because the ratio L/D of the nozzle was too low, frequent fiber breakage occurred immediately below the nozzle and many cotton flies scattered. In this way, a desired nonwoven fabric was not obtained.

Comparative Example 4

The same melt liquid-crystal-forming wholly aromatic polyester as that in Example 1 was extruded from a twin screw extruder and then fed into a meltblown-nonwoven-fabric production unit equipped with a nozzle having a nozzle spout size (diameter) of 0.15 mm, an L/D ratio of 30, and a number of spouts per 1-m width of 650 (distance between nozzle spouts, 1.54 mm). Spraying was conducted at a discharge amount per spout of 0.10 g/minute, a resin temperature of 330° C., a hot-air temperature of 330° C., and an air amount of 18 Nm$^3$ per the width of the nozzle of 1 m. In this way, a nonwoven fabric having a basis weight of 15 g/m$^2$ was obtained. Then, the resultant was treated in air at 300° C. for 6 hours. The resulting nonwoven fabric had an average fiber diameter of 4.5 μm and a number of film-like objects existing per 1 mm$^2$ of the nonwoven fabric of 1. With the large distance between nozzle spouts, the nonwoven fabric had an air permeability of 350 cc/cm$^2$/second and low uniformity. The nonwoven fabric had a tensile tenacity in the warp direction of 15 N/15 mm and a tensile tenacity in the weft direction of 9 N/15 mm. The nonwoven fabric had a small breaking length in the warp direction of 7 km and a small breaking length in the weft direction of 4 km.

Comparative Example 5

The same melt liquid-crystal-forming wholly aromatic polyester as that in Example 1 was extruded from a twin screw extruder and then fed into a meltblown-nonwoven-fabric production unit equipped with a nozzle having a nozzle spout size (diameter) of 0.15 mm, an L/D ratio of 15, and a number of spouts per 1-m width of 1000 (distance between nozzle spouts, 1.0 mm). Spraying was conducted at a discharge amount per spout of 0.30 g/minute, a resin temperature of 315° C., a hot-air temperature of 315° C., and an air amount of 18 Nm$^3$ per the width of the nozzle of 1 m. In this way, a nonwoven fabric having a basis weight of 22 g/m$^2$ was obtained. The resulting nonwoven fabric was subjected to heat treatment in a nitrogen stream at 260° C. for 15 hours and then in air at 260° C. for 5 hours, while a gaseous by-product was adsorbed on a molecular sieve. The resulting nonwoven fabric had an average fiber diameter of 9.5 μm, an air permeability of 190 cc/cm$^2$/second, and a number of film-like objects existing per 1 mm$^2$ of the nonwoven fabric of 4. The nonwoven fabric was thick, having a thickness of 73 μm. The nonwoven fabric had a tensile tenacity in the warp direction of 29 N/15 mm and a tensile tenacity in the weft direction of 15 N/15 mm. The nonwoven fabric had a small breaking length in the warp direction of 9 km and a small breaking length in the weft direction of 5 km.

Comparative Example 6

A nonwoven fabric was obtained in the same manner as in Comparative Example 4 except that the nonwoven fabric had a basis weight of 6 g/m$^2$. The resulting nonwoven fabric had an average fiber diameter of 6.9 μm, a number of film-like objects existing per 1 mm$^2$ of the nonwoven fabric of 3, a tensile tenacity in the warp direction of 6 N/15 mm, a breaking length in the warp direction of 7 km, a tensile tenacity in the weft direction of 3 N/15 mm, and a breaking length in the weft direction of 3 km. The nonwoven fabric was thin, having a thickness of 35 μm. The nonwoven fabric had a high air permeability of 400 cc/cm$^2$/second. Using the nonwoven fabric, a conductive nonwoven fabric was obtained in the same manner as in Example 1. The resulting conductive nonwoven fabric had an electromagnetic-wave-shielding ability of 46 (dB) at a frequency of 100 MHz and 36 (dB) at a frequency of 1 GHz, which was inadequate compared to those in Examples 1 to 3 with the same basis weight.

Results of Examples 1 to 3 and Comparative Examples 4 to 6 are shown in Table 1.

TABLE 1

| | | Example 1 | Example 2 | Example 3 | Comparative Example 4 | Comparative Example 5 | Comparative Example 6 |
|---|---|---|---|---|---|---|---|
| Physical properties of nonwoven fabric | Average fiber diameter (μm) | 2.7 | 2.6 | 2.6 | 4.5 | 9.5 | 7.1 |
| | Basis weight (g/m$^2$) | 15 | 6 | 3 | 15 | 22 | 6 |
| | Thickness (μm) | 34 | 17 | 9 | 55 | 73 | 35 |
| | Breaking length in warp direction (km) | 32 | 27 | 27 | 7 | 9 | 7 |
| | Breaking length in weft direction (km) | 11 | 9 | 7 | 4 | 5 | 3 |
| | Air permeability (cc/cm$^2$/second) | 20 | 80 | 240 | 350 | 190 | 400 |
| | Melting point (° C.) | 335 | 340 | 345 | 325 | 325 | 323 |
| Metal coating film composition | | Cu/Ni | Cu/Ni | Cu/Ni | Cu/Ni | Cu/Ni | Cu/Ni |
| Electromagnetic-wave-shielding ability (Transmittance) | @100 MHz (dB) | 81 | 75 | 70 | 62 | 70 | 46 |
| | @1 GHz (dB) | 80 | 72 | 68 | 55 | 66 | 36 |
| Surface resistance of nonwoven fabric (Ω/□) | | 0.030 | 0.090 | 0.100 | 0.090 | 0.090 | 0.302 |

Example 4

A meltblown nonwoven fabric was obtained in the same manner as in Example 1 except that pressurized calendering was conducted with passage between a metal roll heated to 110° C. and an elastic resin roll having a surface Shore D hardness of 86° (manufactured by Yuri Roll Co., Ltd.) at a linear pressure of 120 kg/cm. The resulting meltblown nonwoven fabric had an average fiber diameter of 2.8 μm (satisfied component (A)), a number of film-like objects existing per 1 mm$^2$ of the nonwoven fabric of 0 (satisfied component (B)) (a scanning electron microscope photograph is shown in FIG. 1), a tensile tenacity in the warp direction of 74 N/15 mm, a tensile tenacity in the weft direction of 26 N/15 mm, a breaking length in the warp direction of 34 km, and a breaking length in the weft direction of 12 km (satisfied component (C)), a basis weight of 15 g/m$^2$ as described above (satisfied component (D)), a thickness of 25 μm (satisfied component (E)), and an air permeability of 12 cc/cm$^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 7 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 85 (dB) at a frequency of 100 MHz and 83 (dB) at a frequency of 1 GHz. The conductive nonwoven fabric had a surface resistance of 0.028 (Ω/□).

Example 5

A meltblown nonwoven fabric having a basis weight of 9 g/m$^2$ (satisfied component (D)) was produced in the same manner as in Example 1. The resulting meltblown nonwoven fabric had an average fiber diameter of 2.8 μm (satisfied component (A)), a number of film-like objects existing per 1 mm$^2$ of the nonwoven fabric of 0 (satisfied component (B)), a tensile tenacity in the warp direction of 42 N/15 mm, a tensile tension in the weft direction of 14 N/15 mm, a breaking length in the warp direction of 32 km, and a breaking length in the weft direction of 11 km (satisfied component (C)), a thickness of 17 μm (satisfied component (E)), and an air permeability of 38 cc/cm$^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 8 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 80 (dB) at a frequency of 100 MHz and 81 (dB) at a frequency of 1 GHz. The conductive nonwoven fabric had a surface resistance of 0.031 (Ω/□).

Example 6

A meltblown nonwoven fabric having a basis weight of 5 g/m$^2$ (satisfied component (D)) was produced in the same manner as in Example 1. The resulting meltblown nonwoven fabric had an average fiber diameter of 2.8 μm (satisfied component (A)), a number of film-like objects existing per 1 mm$^2$ of the nonwoven fabric of 0 (satisfied component (B)), a tensile tenacity in the warp direction of 21 N/15 mm, a tensile tension in the weft direction of 7 N/15 mm, a breaking length in the warp direction of 29 km, and a breaking length in the weft direction of 10 km (satisfied component (C)), a thickness of 13 μm (satisfied component (E)), and an air permeability of 82 cc/cm$^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 9 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 74 (dB) at a frequency of 100 MHz and 71 (dB) at a frequency of 1 GHz. The conductive nonwoven fabric had a surface resistance of 0.091 (Ω/□).

Example 7

A meltblown nonwoven fabric was obtained in the same manner as in Example 1 except that pressurized calendering was conducted with passage between a metal roll heated to 110° C. and an elastic resin roll having a surface Shore D hardness of 86° (manufactured by Yuri Roll Co., Ltd.) at a linear pressure of 450 kg/cm. The resulting meltblown nonwoven fabric had an average fiber diameter of 2.8 μm (satisfied component (A)), a number of film-like objects existing per 1 $mm^2$ of the nonwoven fabric of 0 (satisfied component (B)), a tensile tenacity in the warp direction of 76 N/15 mm, a tensile tenacity in the weft direction of 26 N/15 mm, a breaking length in the warp direction of 34 km, and a breaking length in the weft direction of 12 km (satisfied component (C)), a basis weight of 15 $g/m^2$ as described above (satisfied component (D)), a thickness of 23 μm (satisfied component (E)), and an air permeability of 10 $cc/cm^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 5 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 87 (dB) at a frequency of 100 MHz and 85 (dB) at a frequency of 1 GHz. The conductive nonwoven fabric had a surface resistance of 0.025 (Ω/□).

Example 8

A meltblown nonwoven fabric was obtained in the same manner as in Example 1 except that pressurized calendering was conducted with passage between a metal roll heated to 110° C. and an elastic resin roll having a surface Shore D hardness of 950 (manufactured by Yuri Roll Co., Ltd.) at a linear pressure of 120 kg/cm. The resulting meltblown nonwoven fabric had an average fiber diameter of 2.8 μm (satisfied component (A)), a number of film-like objects existing per 1 $mm^2$ of the nonwoven fabric of 0 (satisfied component (B)), a tensile tenacity in the warp direction of 74 N/15 mm, a tensile tenacity in the weft direction of 26 N/15 mm, a breaking length in the warp direction of 34 km, and a breaking length in the weft direction of 12 km (satisfied component (C)), a basis weight of 15 $g/m^2$ as described above (satisfied component (D)), a thickness of 24 μm (satisfied component (E)), and an air permeability of 12 $cc/cm^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 6 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 87 (dB) at a frequency of 100 MHz and 85 (dB) at a frequency of 1 GHz. The conductive nonwoven fabric had a surface resistance of 0.027 (Ω/□).

Example 9

A meltblown nonwoven fabric was obtained in the same manner as in Example 1 except that pressurized calendering was conducted with passage between a metal roll heated to 110° C. and an elastic resin roll having a surface Shore D hardness of 94° (manufactured by Yuri Roll Co., Ltd.) at a linear pressure of 450 kg/cm. The resulting meltblown nonwoven fabric had an average fiber diameter of 2.9 μm (satisfied component (A)), a number of film-like objects existing per 1 $mm^2$ of the nonwoven fabric of 0 (satisfied component (B)), a tensile tenacity in the warp direction of 72 N/15 mm, a tensile tenacity in the weft direction of 23 N/15 mm, a breaking length in the warp direction of 33 km, and a breaking length in the weft direction of 10 km (satisfied component (C)), a basis weight of 15 $g/m^2$ as described above (satisfied component (D)), a thickness of 20 μm (satisfied component (E)), and an air permeability of 7 $cc/cm^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 3 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 90 (dB) at a frequency of 100 MHz and 87 (dB) at a frequency of 1 GHz. The conductive nonwoven fabric had a surface resistance of 0.023 (Ω/□).

Example 10

A meltblown nonwoven fabric was obtained in the same manner as in Example 1 except that pressurized calendering was conducted with passage between a metal roll heated to 230° C. and an elastic resin roll having a surface Shore D hardness of 940 (manufactured by Yuri Roll Co., Ltd.) at a linear pressure of 120 kg/cm. The resulting meltblown nonwoven fabric had an average fiber diameter of 2.9 μm (satisfied component (A)), a number of film-like objects existing per 1 $mm^2$ of the nonwoven fabric of 0 (satisfied component (B)), a tensile tenacity in the warp direction of 71 N/15 mm, a tensile tenacity in the weft direction of 24 N/15 mm, a breaking length in the warp direction of 32 km, and a breaking length in the weft direction of 11 km (satisfied component (C)), a basis weight of 15 $g/m^2$ as described above (satisfied component (D)), a thickness of 21 μm (satisfied component (E)), and an air permeability of 8 $cc/cm^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 4 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 90 (dB) at a frequency of 100 MHz and 87 (dB) at a frequency of 1 GHz. The conductive nonwoven fabric had a surface resistance of 0.023 (Ω/□).

Example 11

A meltblown nonwoven fabric was obtained in the same manner as in Example 1 except that pressurized calendering was conducted with passage between a metal roll heated to 230° C. and an elastic resin roll having a surface Shore D hardness of 94° (manufactured by Yuri Roll Co., Ltd.) at a linear pressure of 450 kg/cm. The resulting meltblown nonwoven fabric had an average fiber diameter of 3.1 μm (satisfied component (A)), a number of film-like objects existing per 1 $mm^2$ of the nonwoven fabric of 0 (satisfied component (B)), a tensile tenacity in the warp direction of 77 N/15 mm, a tensile tenacity in the weft direction of 26 N/15 mm, a breaking length in the warp direction of 35 km, and a breaking length in the weft direction of 12 km (satisfied component (C)), a basis weight of 15 g/m$^2$ as described above (satisfied component (D)), a thickness of 17 μm (satisfied component (E)), and an air permeability of 5 cc/cm$^2$/second (satisfied component (F)). Thus, the resulting meltblown nonwoven fabric was low in basis weight, small in thickness, high in denseness, and very high in tenacity. The meltblown nonwoven fabric had a surface roughness (Ra) of 2 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 93 (dB) at a frequency of 100 MHz and 90 (dB) at a frequency of 1 GHz. The conductive nonwoven fabric had a surface resistance of 0.018 (Ω/□).

Example 12 (Reference Example 1)

A meltblown nonwoven fabric was obtained in the same manner as in Example 1 except that pressurized calendering was conducted with passage between a metal roll heated to 80° C. and an elastic resin roll having a surface Shore D hardness of 90° (manufactured by Yuri Roll Co., Ltd.) at a linear pressure of 180 kg/cm. The resulting meltblown nonwoven fabric had an average fiber diameter of 2.7 μm, a number of film-like objects existing per 1 mm$^2$ of the nonwoven fabric of 0, a tensile tenacity in the warp direction of 70 N/15 mm, a tensile tenacity in the weft direction of 24 N/15 mm, a breaking length in the warp direction of 32 km, and a breaking length in the weft direction of 11 km, a basis weight of 15 g/m$^2$ as described above, a thickness of 27 μm, and an air permeability of 16 cc/cm$^2$/second. Thus, the resulting meltblown nonwoven fabric was low in basis weight, small in thickness, high in denseness, and very high in tenacity. The meltblown nonwoven fabric had a surface roughness (Ra) of 10 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 83 (dB) at a frequency of 100 MHz and 81 (dB) at a frequency of 1 GHz. The conductive nonwoven fabric had a surface resistance of 0.029 (Ω/□).

Example 13 (Reference Example 2)

A meltblown nonwoven fabric was obtained in the same manner as in Example 1 except that pressurized calendering was conducted with passage between a metal roll heated to 300° C. and an elastic resin roll having a surface Shore D hardness of 90° (manufactured by Yuri Roll Co., Ltd.) at a linear pressure of 180 kg/cm. The resulting meltblown nonwoven fabric had an average fiber diameter of 2.8 μm, a number of film-like objects existing per 1 mm$^2$ of the nonwoven fabric of 1, a tensile tenacity in the warp direction of 77 N/15 mm, a tensile tenacity in the weft direction of 27 N/15 mm, a breaking length in the warp direction of 35 km, and a breaking length in the weft direction of 12 km, a basis weight of 15 g/m$^2$ as described above, a thickness of 30 μm, and an air permeability of 18 cc/cm$^2$/second. Thus, the resulting meltblown nonwoven fabric was low in basis weight, small in thickness, high in denseness, and very high in tenacity. The meltblown nonwoven fabric had a surface roughness (Ra) of 13 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 82 (dB) at a frequency of 100 MHz and 80 (dB) at a frequency of 1 GHz. The conductive nonwoven fabric had a surface resistance of 0.029 (Ω/□).

Example 14 (Reference Example 3)

A meltblown nonwoven fabric was obtained in the same manner as in Example 1 except that pressurized calendering was conducted with passage between a metal roll heated to 200° C. and an elastic resin roll having a surface Shore D hardness of 60° (manufactured by Yuri Roll Co., Ltd.) at a linear pressure of 180 kg/cm. The resulting meltblown nonwoven fabric had an average fiber diameter of 2.7 μm, a number of film-like objects existing per 1 mm$^2$ of the nonwoven fabric of 0, a tensile tenacity in the warp direction of 71 N/15 mm, a tensile tenacity in the weft direction of 24 N/15 mm, a breaking length in the warp direction of 32 km, and a breaking length in the weft direction of 11 km, a basis weight of 15 g/m$^2$ as described above, a thickness of 31 μm, and an air permeability of 19 cc/cm$^2$/second. Thus, the resulting meltblown nonwoven fabric was low in basis weight, small in thickness, high in denseness, and very high in tenacity. The meltblown nonwoven fabric had a surface roughness (Ra) of 14 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 83 (dB) at a frequency of 100 MHz and 81 (dB) at a frequency of 1 GHz. The conductive nonwoven fabric had a surface resistance of 0.029 (Ω/□).

Example 15 (Reference Example 4)

A meltblown nonwoven fabric was obtained in the same manner as in Example 1 except that pressurized calendering was conducted with passage between a metal roll heated to 200° C. and an elastic resin roll having a surface Shore D hardness of 98° (manufactured by Yuri Roll Co., Ltd.) at a linear pressure of 180 kg/cm. The resulting meltblown nonwoven fabric had an average fiber diameter of 2.9 μm, a number of film-like objects existing per 1 mm$^2$ of the nonwoven fabric of 0, a tensile tenacity in the warp direction of 72 N/15 mm, a tensile tenacity in the weft direction of 25 N/15 mm, a breaking length in the warp direction of 33 km, and a breaking length in the weft direction of 11 km, a basis weight of 15 g/m$^2$ as described above, a thickness of 23 μm, and an air permeability of 12 cc/cm$^2$/second. Thus, the resulting meltblown nonwoven fabric was low in basis weight, small in thickness, high in denseness, and very high in tenacity. The meltblown nonwoven fabric had a surface roughness (Ra) of 14 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 80 (dB) at a frequency of 100 MHz and 78 (dB) at a frequency of 1 GHz. The conductive nonwoven fabric had a surface resistance of 0.031 (Ω/□).

Example 16 (Reference Example 5)

A meltblown nonwoven fabric was obtained in the same manner as in Example 1 except that pressurized calendering was conducted with passage between a metal roll heated to 200° C. and an elastic resin roll having a surface Shore D hardness of 90° (manufactured by Yuri Roll Co., Ltd.) at a linear pressure of 60 kg/cm. The resulting meltblown nonwoven fabric had an average fiber diameter of 2.7 μm, a number of film-like objects existing per 1 $mm^2$ of the nonwoven fabric of 0, a tensile tenacity in the warp direction of 72 N/15 mm, a tensile tenacity in the weft direction of 24 N/15 mm, a breaking length in the warp direction of 33 km, and a breaking length in the weft direction of 11 km, a basis weight of 15 $g/m^2$ as described above, a thickness of 28 μm, and an air permeability of 17 $cc/cm^2$/second. Thus, the resulting meltblown nonwoven fabric was low in basis weight, small in thickness, high in denseness, and very high in tenacity. The meltblown nonwoven fabric had a surface roughness (Ra) of 12 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 82 (dB) at a frequency of 100 MHz and 80 (dB) at a frequency of 1 GHz. The conductive nonwoven fabric had a surface resistance of 0.030 (Ω/□).

Example 17 (Reference Example 6)

A meltblown nonwoven fabric was obtained in the same manner as in Example 1 except that pressurized calendering was conducted with passage between a metal roll heated to 200° C. and an elastic resin roll having a surface Shore D hardness of 90° (manufactured by Yuri Roll Co., Ltd.) at a linear pressure of 800 kg/cm. The resulting meltblown nonwoven fabric had an average fiber diameter of 3.0 μm, a number of film-like objects existing per 1 $mm^2$ of the nonwoven fabric of 1, a tensile tenacity in the warp direction of 60 N/15 mm, a tensile tenacity in the weft direction of 15 N/15 mm, a breaking length in the warp direction of 27 km, and a breaking length in the weft direction of 7 km, a basis weight of 15 $g/m^2$ as described above, a thickness of 14 μm, and an air permeability of 6 $cc/cm^2$/second. Thus, the resulting meltblown nonwoven fabric was low in basis weight, small in thickness, high in denseness, and very high in tenacity. The meltblown nonwoven fabric had a surface roughness (Ra) of 9 μm. Using the meltblown nonwoven fabric, a conductive nonwoven fabric was obtained in the same manner as in Example 1. The resulting conductive nonwoven fabric had a melting point of 335° C. and thereby had very high heat resistance. The conductive nonwoven fabric had an excellent electromagnetic-wave-shielding ability of 85 (dB) at a frequency of 100 MHz and 83 (dB) at a frequency of 1 GHz. The conductive nonwoven fabric had a surface resistance of 0.028 (Ω/□).

Comparative Example 7

The same melt liquid-crystal-forming wholly aromatic polyester as that in Example 4 was extruded from a twin screw extruder and then fed into a meltblown-nonwoven-fabric production unit equipped with a nozzle having a nozzle spout size (diameter) of 0.2 mm, an L/D ratio of 10, and a number of spouts per 1-m width of 1500 (distance between nozzle spouts, 0.67 mm). Spraying was conducted at a discharge amount per spout of 0.40 g/minute, a resin temperature of 330° C., a hot-air temperature of 330° C., and an air amount of 18 $Nm^3$ per the width of the nozzle of 1 m. In this way, a nonwoven fabric having a basis weight of 15 $g/m^2$ was obtained. Because the ratio L/D of the nozzle was too small, many fibers broke immediately below the nozzle and contaminated the nonwoven fabric. The resulting nonwoven fabric was subjected to heat treatment in air at 300° C. for 6 hours. Subsequently, the nonwoven fabric was subjected to pressurized calendering, in which the nonwoven fabric was passed between a metal roll heated to 100° C. and an elastic resin roll having a surface Shore D hardness of 60° (manufactured by Yuri Roll Co., Ltd.) at a linear pressure of 30 kg/cm. In this way, a meltblown nonwoven fabric was obtained. The resulting meltblown nonwoven fabric had an average fiber diameter of 9.2 μm, a number of film-like objects existing per 1 $mm^2$ of the nonwoven fabric of 4, a tensile tenacity in the warp direction of 12 N/15 mm, a tensile tenacity in the weft direction of 5 N/15 mm, a breaking length in the warp direction of 5 km, and a breaking length in the weft direction of 2 km, a basis weight of 15 $g/m^2$ as described above, a thickness of 67 μm, and an air permeability of 415 $cc/cm^2$/second. The meltblown nonwoven fabric had a surface roughness (Ra) of 19 μm. Using the meltblown nonwoven fabric, a conductive nonwoven fabric was obtained in the same manner as in Example 4. The resulting conductive nonwoven fabric had a melting point of 335° C. and thereby had very high heat resistance. The conductive nonwoven fabric had an electromagnetic-wave-shielding ability of 45 (dB) at a frequency of 100 MHz and 36 (dB) at a frequency of 1 GHz. The conductive nonwoven fabric had a surface resistance of 0.295 (Ω/□).

Results of Examples 4 to 11 are shown in Table 2. Results of Examples 12 to 17 and Comparative Example 7 are shown in Table 3.

TABLE 2

| | | Example 4 | Example 5 | Example 6 | Example 7 | Example 8 | Example 9 | Example 10 | Example 11 |
|---|---|---|---|---|---|---|---|---|---|
| Physical properties of nonwoven fabric | Average fiber diameter (μm) | 2.8 | 2.8 | 2.8 | 2.8 | 2.8 | 2.9 | 2.9 | 3.1 |
| | Basis weight ($g/m^2$) | 15 | 9 | 5 | 15 | 15 | 15 | 15 | 15 |
| | Thickness (μm) | 25 | 17 | 13 | 23 | 24 | 20 | 21 | 17 |
| | Breaking length in warp direction (km) | 34 | 32 | 29 | 34 | 34 | 33 | 32 | 35 |
| | Breaking length in weft direction (km) | 12 | 11 | 10 | 12 | 12 | 10 | 11 | 12 |
| | Air permeability ($cc/cm^2$/second) | 12 | 38 | 82 | 10 | 12 | 7 | 8 | 5 |
| | Melting point (° C.) | 335 | 335 | 335 | 335 | 335 | 335 | 335 | 335 |
| | Surface roughness (Ra) (μm) | 7 | 8 | 9 | 5 | 6 | 3 | 4 | 2 |

TABLE 2-continued

| | | Example 4 | Example 5 | Example 6 | Example 7 | Example 8 | Example 9 | Example 10 | Example 11 |
|---|---|---|---|---|---|---|---|---|---|
| Metal coating film composition | | Cu/Ni | Cu/Ni | Cu/Ni | Cu/Ni | Cu/Ni | Cu/Ni | Cu/Ni | Cu/Ni |
| Electromagnetic-wave-shielding ability (Transmittance) | @100 MHz (dB) | 85 | 80 | 74 | 87 | 87 | 90 | 90 | 93 |
| | @1 GHz (dB) | 83 | 81 | 71 | 85 | 85 | 87 | 87 | 90 |
| Surface resistance of nonwoven fabric (Ω/□) | | 0.028 | 0.031 | 0.091 | 0.025 | 0.027 | 0.023 | 0.023 | 0.018 |

TABLE 3

| | | Example 12 | Example 13 | Example 14 | Example 15 | Example 16 | Example 17 | Comparative Example 7 |
|---|---|---|---|---|---|---|---|---|
| Physical properties of nonwoven fabric | Average fiber diameter (μm) | 2.7 | 2.8 | 2.7 | 2.9 | 2.7 | 3.0 | 9.2 |
| | Basis weight (g/m$^2$) | 15 | 15 | 15 | 15 | 15 | 15 | 15 |
| | Thickness (μm) | 27 | 30 | 31 | 23 | 28 | 14 | 67 |
| | Breaking length in warp direction (km) | 32 | 35 | 32 | 33 | 33 | 27 | 5 |
| | Breaking length in weft direction (km) | 11 | 12 | 11 | 11 | 11 | 7 | 2 |
| | Air permeability (cc/cm$^2$/second) | 16 | 18 | 19 | 12 | 17 | 6 | 415 |
| | Melting point (° C.) | 335 | 335 | 335 | 335 | 335 | 335 | 335 |
| | Surface roughness (Ra) (μm) | 10 | 13 | 14 | 14 | 12 | 9 | 19 |
| Metal coating film composition | | Cu/Ni | Cu/Ni | Cu/Ni | Cu/Ni | Cu/Ni | Cu/Ni | Cu/Ni |
| Electromagnetic-wave-shielding ability (Transmittance) | @100 MHz (dB) | 83 | 82 | 83 | 80 | 82 | 85 | 45 |
| | @1 GHz (dB) | 81 | 80 | 81 | 78 | 80 | 83 | 36 |
| Surface resistance of nonwoven fabric (Ω/□) | | 0.029 | 0.029 | 0.029 | 0.031 | 0.030 | 0.028 | 0.295 |

INDUSTRIAL APPLICABILITY

The present invention relates to a conductive nonwoven fabric that is very light and thin, shields against electromagnetic waves having a wide range of frequencies, has a wide range of applications such as electromagnetic-wave-shielding sheets, gaskets, and bags, and is particularly useful for applications inside electronic devices that are demanded to be smaller and thinner. The present invention also relates to a method of producing a meltblown nonwoven fabric used in the conductive nonwoven fabric.

The invention claimed is:

1. A conductive nonwoven fabric, comprising:

a meltblown nonwoven fabric comprising a melt liquid-crystal-forming wholly aromatic polyester having a melt viscosity at 310° C. of less than or equal to 20 Pas, the meltblown nonwoven fabric satisfying (A), (B), (C), (D), (E), and (F); and a metal coating film formed on the meltblown nonwoven fabric:

(A) an average fiber diameter from 0.5 to 4 μm;

(B) two or less film-like objects existing per 1 mm$^2$ of the nonwoven fabric;

(C) a breaking length in a warp direction of greater than or equal to 10 km and a breaking length in a weft direction of greater than or equal to 6 km;

(D) a basis weight from 1.0 g/m$^2$ to 15 g/m$^2$;

(E) a thickness from 5 μm to 50 μm; and (F) an air permeability of less than or equal to 82 cc/cm$^2$/second.

2. The fabric of claim 1, wherein the meltblown nonwoven fabric further satisfies satisfying (G):

(G) a surface roughness (Ra) of less than or equal to 15 μm.

3. The fabric of claim 1, wherein the metal coating film comprises at least one selected from the group consisting of copper, nickel, gold, silver, cobalt, tin, and zinc.

4. The fabric of claim 1, wherein the metal coating film comprises an alloy or a laminate film of at least two selected from the group consisting of copper, nickel, gold, silver, cobalt, tin, and zinc.

5. A conductive tape, comprising the fabric of claim 1.

6. A method of producing a meltblown nonwoven fabric, the method comprising:

melt spinning a melt liquid-crystal-forming wholly aromatic polyester using a spinning nozzle to obtain a spun product while blowing the spun product at a spinning temperature from 310° C. to 360° C. with air in an amount from 5 Nm$^3$ to 30 Nm$^3$ per a width of the spinning nozzle of 1 m, thereby forming a web on a collecting plane; and conducting heat treatment to produce the meltblown nonwoven fabric, the melt spinning being conducted through the spinning nozzle having a nozzle spout size from 0.1 mm to 0.3 mm, a ratio (L/D) of a nozzle spout length (L) to the nozzle spout size (D) from 20 to 50, and a distance between nozzle spouts from 0.2 mm to 1.0 mm, the heat treatment being conducted at a temperature of greater than or equal to <(a melting point of the melt liquid-crystal-forming wholly aromatic polyester) 40° C.> and less than or equal to <(the melting point of the melt liquid-crystal-forming wholly aromatic polyester)+20° C.> for a period of greater than or equal to 3 hours.

7. The method of claim 6, further comprising: continuously treating the meltblown nonwoven fabric between an elastic roll having a surface Shore D hardness from 85° to 95° and a metal roll at a temperature from 100° C. to 250° C. and a linear pressure from 100 kg/cm to 500 kg/cm.

8. The method of claim 6, wherein the ratio (L/D) is no more than 45.

9. The fabric of claim 1, wherein the metal coating film comprises copper.

10. The fabric of claim 1, wherein the metal coating film comprises nickel.

11. The fabric of claim 1, wherein the metal coating film comprises gold.

12. The fabric of claim 1, wherein the metal coating film comprises silver.

13. The fabric of claim 1, wherein the metal coating film comprises cobalt.

14. The fabric of claim 1, wherein the metal coating film comprises tin.

15. The fabric of claim 1, wherein the metal coating film comprises zinc.

16. The fabric of claim 1, wherein the average fiber diameter (A) is in a range of from 1 to 4 μm.

17. The fabric of claim 1, wherein the average fiber diameter (A) is in a range of from 1 to 3 μm.

18. The fabric of claim 1, wherein the air permeability (F) is at least 1 $cc/cm^2$/second.

19. The fabric of claim 1, wherein the polyester comprises, in polymerized form, p-hydroxybenzoic acid, 2-hydroxy-6-naphthoic acid, and/or biphenol.

20. The fabric of claim 1, wherein the polyester comprises a repeating unit of the formula:

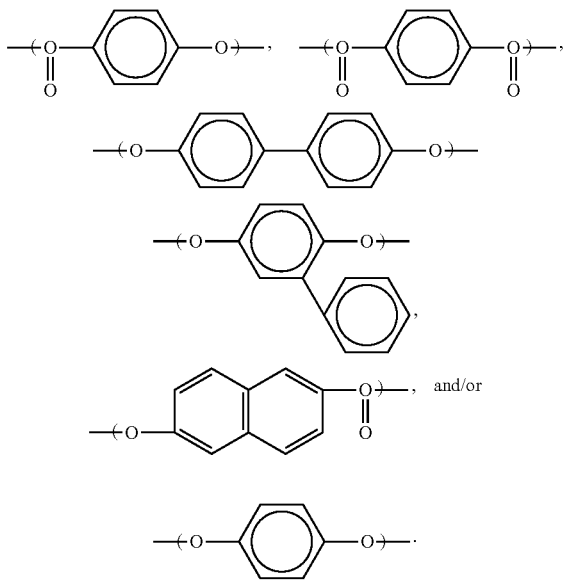

* * * * *